US006098550A

United States Patent [19]

Tsuboi

[11] Patent Number: 6,098,550

[45] Date of Patent: Aug. 8, 2000

[54] STREAMLINE TRACK SYSTEM FOR SELF-DRIVING CARRIERS

[76] Inventor: Nobuyuki Tsuboi, 23-2-706 Hayakocho, Neyagawa, Osaka 572-0837, Japan

[21] Appl. No.: 09/090,424

[22] Filed: Jun. 4, 1998

[51] Int. Cl.[7] ..... B61C 11/04

[52] U.S. Cl. ..... 105/29.1; 105/127

[58] Field of Search ..... 105/29.1, 30, 96, 105/127, 133, 144; 104/106, 119; 384/13, 55, 57, 58

[56] References Cited

U.S. PATENT DOCUMENTS

| | | | |
|---|---|---|---|
| 5,069,141 | 12/1991 | Ohara et al. | 105/30 |
| 5,086,705 | 2/1992 | Jarvis | 105/29.1 |
| 5,562,043 | 10/1996 | Gromes | 105/29.1 |
| 5,735,214 | 4/1998 | Tsuboi | 105/29.1 |
| 5,924,365 | 7/1999 | Pircher | 105/29.1 |

*Primary Examiner*—S. Joseph Morano
*Assistant Examiner*—Lars A. Olson
*Attorney, Agent, or Firm*—Oblon, Spivak, McClelland, Maier & Neustadt, P.C.

[57] ABSTRACT

A track system for at least one self-driving carrier to run along a streamline guide rail combined with a gear way which comprises a plurality of straight and curving gear way segments molded with reinforced thermosetting resin and connected with each other by the intermediary of straight joint members, each having a pair of opposed parallel set to sides and a pair of opposed parallel gear sides with gear teeth of a given pitch, wherein each curving gear way segment has a curving middle part and straight extensions formed at both ends thereof, the gear teeth of a given pitch being arranged symmetrically on both gear sides along the straight gear way segments, the straight extensions of curving gear way segments and the straight joint members.

11 Claims, 10 Drawing Sheets

STREAMLINE TRACK SYSTEM FOR SELF-DRIVING CARRIERS

BACKGROUND OF THE INVENTION

The present invention relates to a track system, and more particularly to improvements on my U.S. Pat. No. 5,735,214, issued Apr. 7, 1998, entitled Streamline Track System with Carriers and Rail.

In the above-mentioned U.S. Patent, at least one carrier equipped with roller assemblies is adapted to run along a straight and/or curving guide rail either by outside driving means or automatically by self-driving means.

The guide rail has a pair of opposed parallel guide sides and a pair of opposed parallel set sides. Each of the guide sides is provided with a pair of parallel plain lanes and a V edge protruded between the pair of parallel plain lanes. The V edge has a top portion and a base portion. The guide rail is fixed to a supporting structure with set bolts through the set sides either directly or by the intermediary of at least one base member.

The carrier has a frame and a plurality of roller assemblies secured to the frame for supporting the carrier by engaging with the opposed parallel guide sides. Each of the roller assemblies comprises a journal and a pair of ball bearings mounted on the journal with a space left between the pair of ball bearings. Each of the pair of ball bearings includes an outer race which engages with each of the pair of parallel plain lanes and which has a beveled corner facing to the V edge. Each of the pair of ball bearings is adapted to cooperate with the V edge such that the beveled corner engages with the V edge base portion, and such that the V edge top portion remains in the space between the pair of ball bearings without engaging the outer race.

Thus the carrier is adapted to run along the guide rail not only by the engagement of the V edge base portion and the ball bearing beveled corners but also by the engagement of the parallel plain lanes and the ball bearing outer races except the beveled corners, while the V edge top portion remains free of engagement, at each of the guide sides of the guide rail.

In case the guide rail is a streamline which has a plurality of straight and curving rail segments connected with each other, each of the curving rail segments comprises a curving middle part and straight extensions formed at both ends of the curving middle part. These straight extensions are connected with straight rail segments or similarly formed straight extensions of other curving rail segments. Thus the guide rail has no straight-to-curving joint but straight-to-straight joints only, though it includes both straight and curving rail segments.

In case the carrier is adapted to run automatically by self-driving means, the guide rail is fixed to a supporting structure by the intermediary of base members, and a gear rack is provided at one side of the base members along one of the guide sides. A motor with a drive shaft is mounted on the carrier frame. A pinion is connected to the drive shaft and adapted to engage with the gear rack. Thus the carrier runs automatically along the guide rail as the motor drives the pinion in engagement with the gear rack.

It can be said that the above-described automatic running system has an outstanding advantage that there is no need of providing outside driving means which may include chains, belts, rods or screws all along the guide rail, thus not only saving cost and space but also facilitating installation and minimizing maintenance. This advantage is especially great in case the guide rail is such a streamline as includes a plurality of various curving rail segments.

However, a streamline guide rail for a self-driving carrier will require a streamline gear rack just suitable to be combined with the guide rail. And it is desired that this streamline gear rack is not only accurate, strong, durable, stable, noiseless, light and compact, but also easy and cost-saving to manufacture, install, operate and maintain, whatever curvature and length it may have on one plane. It is even desired that the gear rack can be combined with a guide rail having a three-dimensional running direction.

BRIEF SUMMARY OF THE INVENTION

It is a main object of the invention to provide a track system in which at least one self-driving carrier equipped with roller assemblies runs along a streamline guide rail combined with a streamline gear way just suitable for the guide rail.

Another object of the invention is to provide a streamline gear way just suitable to be combined with a streamline guide rail for self-driving carriers, whatever curvature and length it may have on one plane.

A further object of the invention is to provide a streamline gear way which is not only accurate, strong, durable, stable, noiseless, light and compact, but also easy and cost-saving to manufacture, install, operate and maintain.

A more specific object of the invention is to provide a streamline gear way by molding reinforced thermosetting resin into a form that it has a pair of opposed parallel gear sides and a pair of opposed parallel set sides.

A still further object of the invention is to provide a gear way suitable to be combined with a guide rail having a three-dimensional running direction.

Other objects and advantages of the invention will be apparent from the following description and the accompanying drawings.

A track system in accordance with the invention comprises a guide rail, a gear way combined with the guide rail, and at least one carrier to run along the guide rail automatically by self-driving means.

The guide rail has a pair of opposed parallel guide sides and a pair of opposed parallel set sides. Each of the guide sides is provided with a pair of parallel plain lanes and a V edge protruded between the pair of parallel plain lanes. The V edge has a top portion and a base portion. The set sides are provided with rivet holes through them.

The gear way has a pair of opposed parallel gear sides and a pair of opposed parallel set sides. Both of the gear sides are provided with gear teeth of a given pitch. The set sides are provided with rivet holes through them. One of the set sides is provided with ribs protruded outwardly. The guide rail is combined with the gear way by putting resilient hollow rivets through the rivet holes. The combination of guide rail and gear way is fixed to a supporting structure on one plane with set bolts passing through the resilient hollow rivets.

The carrier is of bogie type. It comprises a first frame, a second frame, a top plate bridging both frames, and a geared motor mounted on the top plate. The first frame includes a driving roller assembly and a non-driving roller assembly. The second frame includes a pair of non-driving roller assemblies. Each of the non-driving roller assemblies has a pair of ball bearings mounted on a journal. The ball bearings engage with one of the guide sides to support the carrier. The driving roller assembly has a ball bearing and a pinion mounted on a journal. The ball bearing engages with one of the guide sides to support the carrier, while the pinion is in a driving relation to the geared motor and engages with one of the gear sides to drive the carrier. The carrier runs automatically along the guide rail as the motor drives the pinion in engagement with the gear way.

The guide rail comprises a plurality of straight and curving guide rail segments connected with each other into a streamline. Each curving guide rail segment has a curving middle part and straight extensions formed integrally at both ends of it, so that there are no straight-to-curving guide rail joints but straight-to-straight joints only all along the streamline guide rail.

The gear way comprises a plurality of straight and curving gear way segments connected with each other by the intermediary of straight joint members into a streamline. Each curving gear way segment has a curving middle part and straight extensions formed integrally at both ends of it, so that there are no straight-to-curving gear way joints but straight-to-straight joints only all along the streamline gear way.

Each of the straight and curving gear way segments and straight joint members is molded with thermosetting resin reinforced with carbon fiber, glass fiber, and/or laminates of a woven fabric impregnated with thermosetting resin.

Each straight gear way segment, both straight extensions of each curving gear way segment and each straight joint member have gear teeth of a given pitch arranged symmetrically on both gear sides, so that they can be connected with each other into a streamline gear way without disturbing the pitch of gear teeth, whatever curvature and length it may have on one plane. In this case, the symmetrical arrangement of gear teeth on both gear sides of the straight extensions of each curving gear way segment makes it possible to form the straight extensions integrally at both ends of the curving middle part without disturbing the pitch of gear teeth. The symmetrical arrangement of gear teeth on both gear sides and the existence of ribs on one of the set sides are quite effective to minimize natural deformation after molding of the gear way segments and the joint members.

The gear way can be made to have a three-dimensional running direction. In this case, neither of the gear sides may be provided with ribs.

DETAILED DESCRIPTION OF THE INVENTION

Referring to FIGS. 1 through 11, the streamline track system embodying the invention comprises a guide rail 10, a gear way 15 combined with the guide rail 10, and a carrier 20 to run along the guide rail 10 automatically by self-driving means to transfer articles (not shown) attached to the carrier 20.

Figure 3:
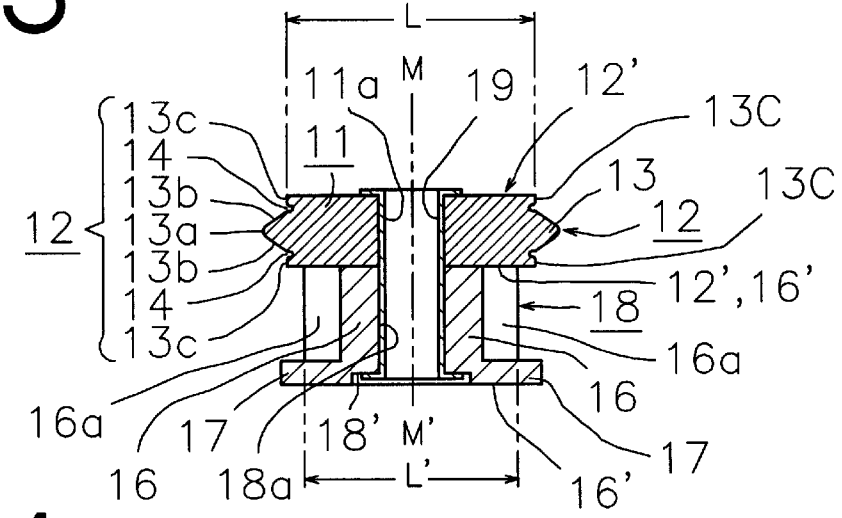
FIG. 3 is a vertical section taken approximately on the line III—III in FIG. 1, where the set bolt is removed.

The guide rail 10 comprises a plurality of straight and curving guide rail segments 11. Each of the guide rail segments 11 has a pair of opposed parallel guide sides 12 and a pair of opposed parallel set sides 12' as best shown in FIG. 3. Each of the guide sides 12 is provided with a pair of parallel plain lanes **13*c* and a V edge 13 protruded between the pair of parallel plain lanes 13*c*. The V edge 13 has a top portion 13*a* and a base portion 13*b*. Each guide side 12 is provided with a pair of narrow lubricating grooves 14 between the plain lanes 13*c* and the V edge base portion 13*b*. The set sides 12' are provided with rivet holes 11*a*** through them.

The straight guide rail segments are manufactured by drawing or rolling carbon steel and other metallic materials. The curving guide rail segments are machine-made from the same materials.

The gear way 15 comprises a plurality of straight and curving gear way segments 18. Each of the gear way segments 18 has a pair of opposed parallel gear sides 16 and a pair of opposed parallel set sides 16' as best shown in FIG. 3. Both of the gear sides 16 are provided with gear teeth **16*a* of a given pitch. In each straight gear way segment 18, the gear teeth 16*a* on both gear sides 16 are arranged symmetrically in relation to the imaginary center line M–M' in the cross section as shown in FIG. 3. The set sides 16' are provided with rivet holes 18*a* through them. One of the set sides 16' is provided with spot facings 18' around the rivet holes 18*a* respectively and also with a pair of ribs 17 protruded outwardly. The other of the set sides 16'** is plain and ground up.

The straight and curving gear way segments 18 are molded with reinforced thermosetting resin, for instance, phenol resin including carbon fiber, glass fiber and/or laminates of a woven fabric impregnated with thermosetting resin.

Each guide rail segment 11 is combined with a gear way segment 18 by putting resilient hollow rivets 19 through the rivet holes **11*a* and 18*a*. When combined as shown in FIG. 3, the width L between the plain lanes 13*c* on both guide sides 12** is larger than the width L' between the gear teeth 16*a* on both gear sides 16. The resilient hollow rivets 19 are made from spring stainless steel or other similar materials.

Figure 4:
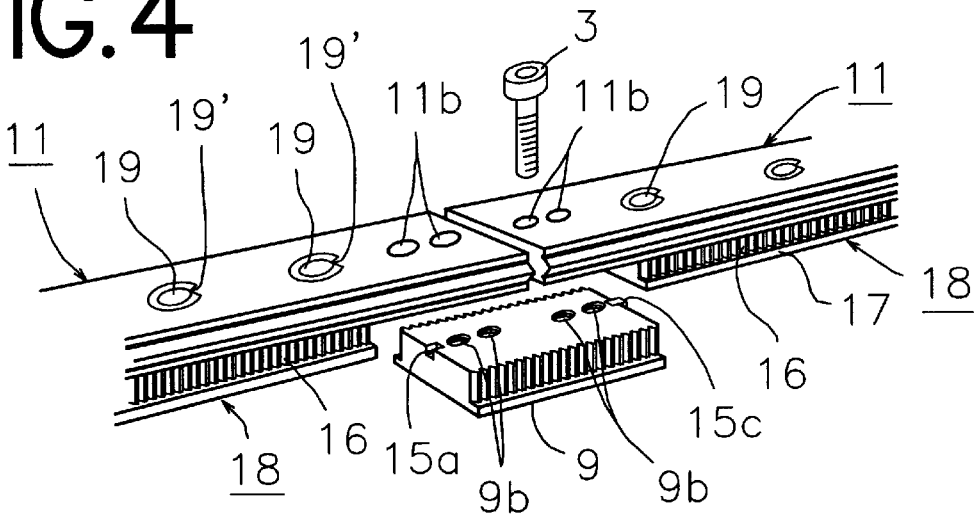
FIG. 4 is a perspective view of two adjacent guide rail segments and gear way segments with a joint member in part embodying the invention.

Each guide rail segment 11 is longer than the gear way segment 18 combined with it, so that the end of each guide rail segment 11 to be connected with an adjacent guide rail segment is not covered with its own combined gear way segment 18 as best shown in FIG. 4. This connecting end is provided with a pair of bolt holes 11*b*.

Any two adjacent guide rail segments 11 combined with gear way segments 18 are connected with each other by putting a joint member 9 between the gear way segments 18. The joint member 9 is molded with the same reinforced thermosetting resin, and has the same straight construction, as the adjacent gear way segments, except that it is just long enough to fill the gap between the adjacent gear way segments 18, and that it is provided with a pair of bolt holes 9*b* in each end of it correspondingly to the bolt holes 11*b* in each of the adjacent guide rail segments 11, as best shown in FIG. 4.

The adjacent ends of the gear way segments 18 and joint member 9 are provided with small key grooves 15*a* along the imaginary longitudinal center line of the guide rail 10 respectively. Any two adjacent guide rail segments 11 combined with gear way segments 18 are held in a good alignment by inserting spring pins 15*c* into the key grooves 15*a*, and then firmly connected with each other by tightening bolts 3 into the bolt holes 11*b* and 9*b*.

Thus all the guide rail segments 11 and gear way segments 18 are connected with each other in a good alignment to complete the guide rail 10 combined with the gear way 15 in a streamline. The complete streamline combination of guide rail 10 and gear way 15 is fixed to a supporting structure 1 on one plane by tightening set bolts 2 through the resilient hollow rivets 19.

Each resilient hollow rivet 19 is split vertically as 19' so as to be radially expansible as best shown in FIG. 4. One end of each hollow rivet 19 is radially pre-expanded before use, while the other end of it is left upright before use and is to be expanded on use. Each hollow rivet 19 is put through the rivet holes 11*a* and 18*a* as shown in FIG. 3 such that the pre-expanded end is retained within the spot facing 18', and such that the upright end is expanded on the counter surface of each guide rail segment 11. Thus each metallic guide rail segment 11 and a resinous gear way segment 18 are combined together in a closely fitting relation to each other, one of the metallic set sides 12' and the plain one of the resinous set sides 16' being face to face.

On this occasion, the middle portion between both ends of each resilient hollow rivet 19 will radially expand itself and fit closely onto the insides of rivet holes 11*a* and 18*a* with its own resiliency. Moreover, the expanded end of hollow rivet 19 on the surface of guide rail segment 11 serves as a washer for the set bolt 2 to be tightened through the hollow rivet 19.

Figure 5:
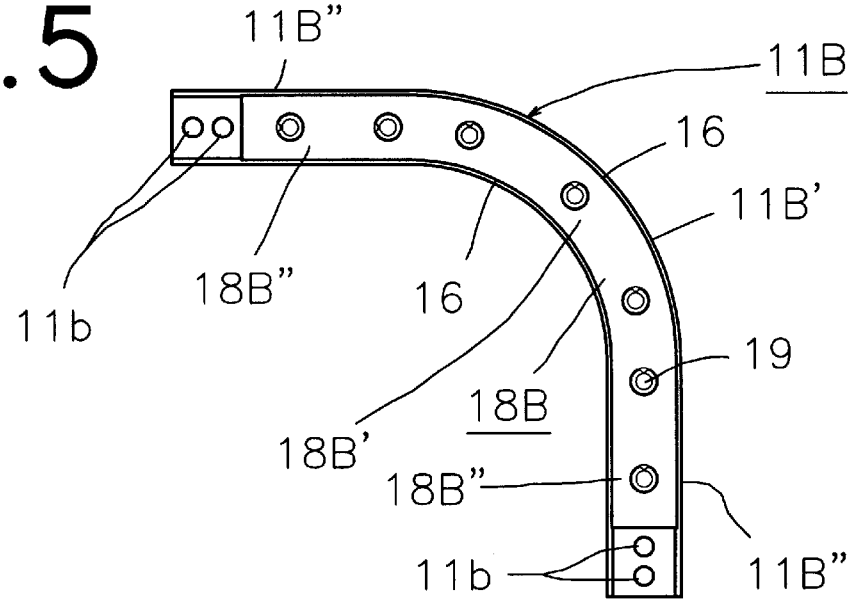
FIG. 5 is a bottom plan view of a curving guide rail segment combined with a curving gear way segment embodying the invention.
Figure 6:
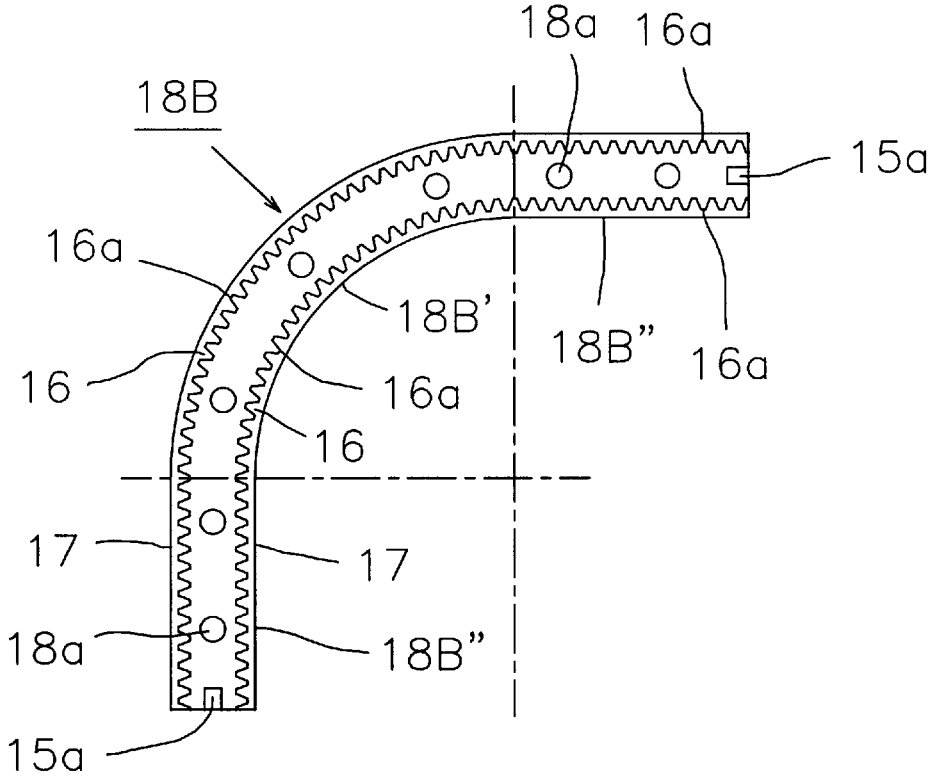
FIG. 6 is a plan view of the curving gear way segment in FIG. 5.

The guide rail 10 may include such a curving guide rail segment combined with a curving gear way segment as shown in FIGS. 5 and 6, where they are designated as 11B and 18B respectively.

The curving guide rail segment 11B has a curving middle part 11B' and straight extensions 11B" formed integrally at both ends of it. The straight extensions 11B" are to be connected with straight guide rail segments or similarly formed straight extensions of other curving guide rail segments. The curving gear way segment 18B also has a curving middle part 18B' and straight extensions 18B" formed integrally at both ends of it. The straight extensions 18B" are to be connected with joint members 9 which have the same straight construction as the straight gear way segments.

The gear teeth 16*a* on both gear sides 16 have a given pitch not only along the straight extensions 18B" but also along the curving middle part 18B'. Along the straight extensions 18B" the gear teeth 16*a* are arranged symmetrically as shown in FIG. 3. This symmetrical arrangement makes it possible to form the straight extensions 18B" integrally at both ends of the curving middle part 18B' without disturbing the pitch of gear teeth 16*a*.

Figure 7:
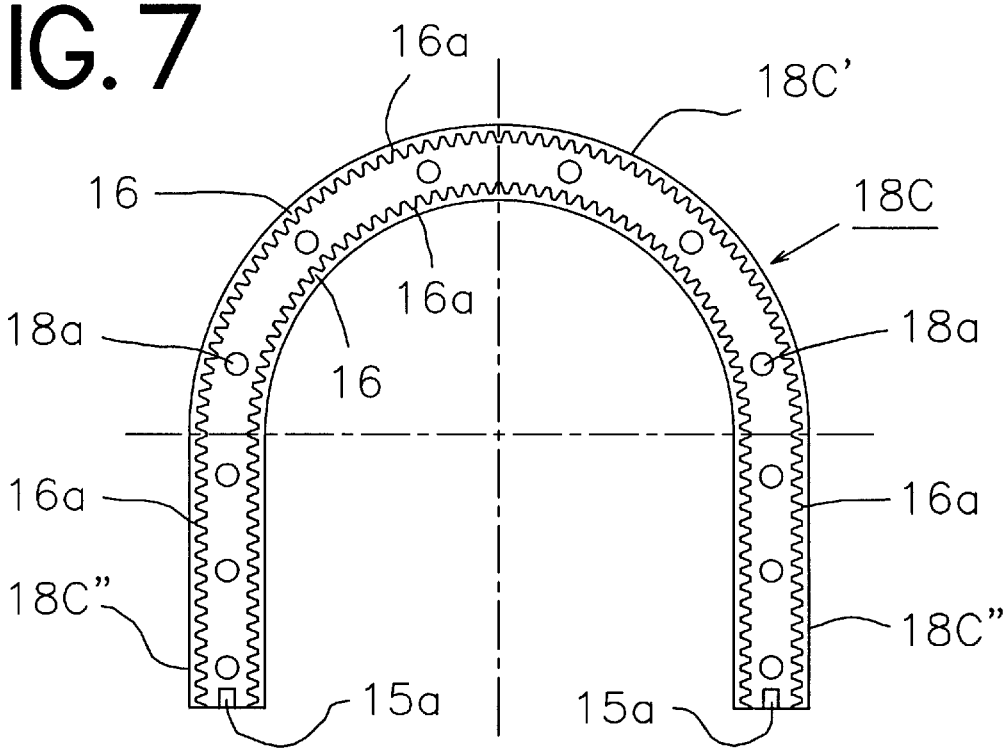
FIG. 7 is a plan view of another curving gear way segment embodying the invention.

The guide rail 10 may also include a curving guide rail segment combined with such a curving gear way segment as shown in FIG. 7, where it is designated as 18C. The curving gear way segment 18C has a curving middle part 18C' and straight extensions 18C" formed integrally at both ends of it. The straight extensions 18C" are to be connected with straight joint members 9. The gear teeth 16*a* on both gear sides 16 have a given pitch not only along the straight extensions 18C" but also along the curving middle part 18C', with the gear teeth 16*a* being arranged symmetrically along the straight extensions 18C" just like the gear way segment 18B in FIG. 6.

Figure 8:
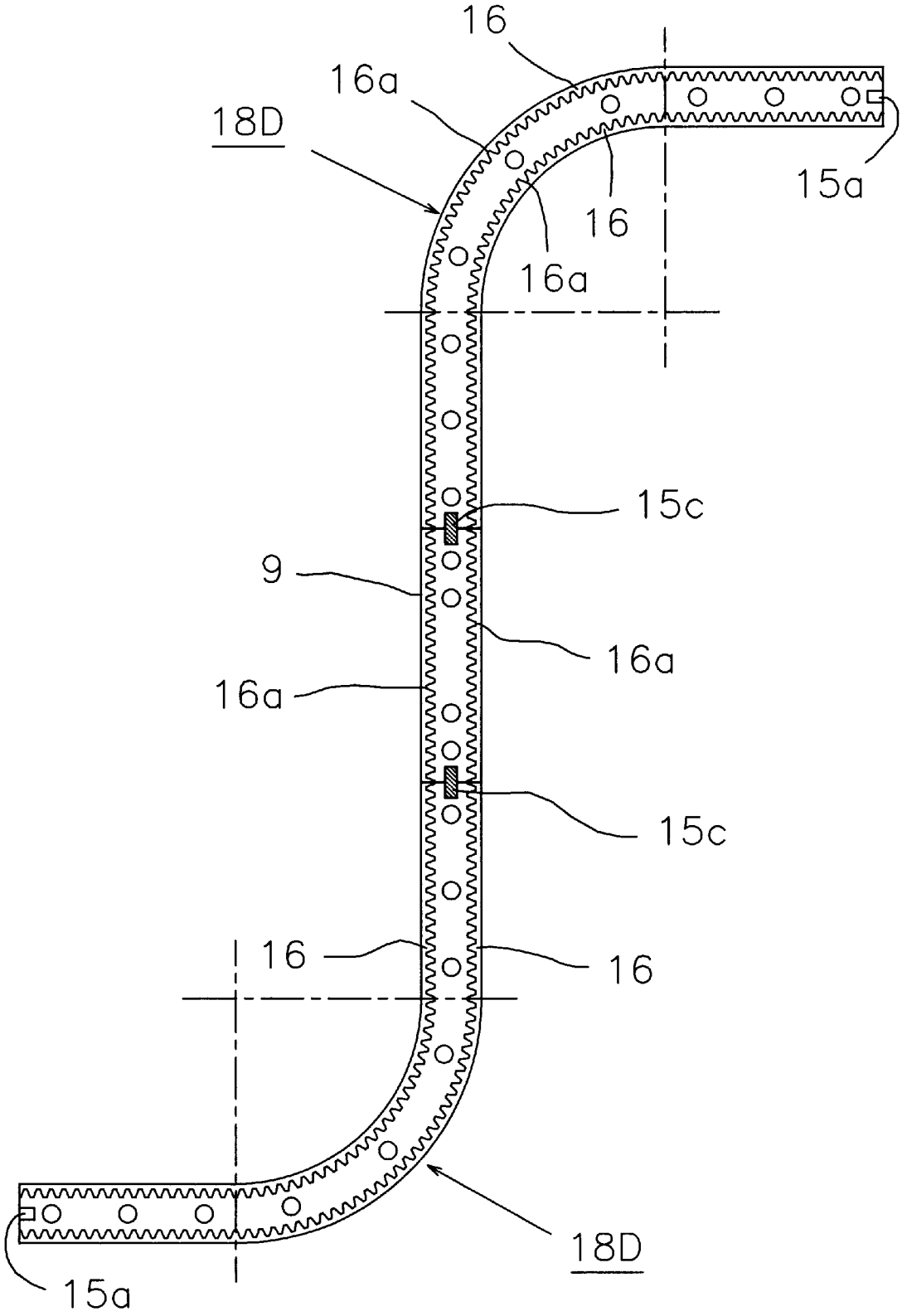
FIG. 8 is a plan view of curving gear way segments connected in "S" shape embodying the invention.

The guide rail 10 may further include curving guide rail segments combined with such curving gear way segments connected in S shape as shown in FIG. 8, where they are wholly designated as 18D. The S shape is a combination of two curving gear way segments similar to the one in FIG. 6 and connected with each other by the intermediary of a joint member 9.

Various other curving gear way segments may be formed similarly and combined with various other curving guide rail segments respectively. Thus there are no straight-to-curving joints but straight-to-straight joints only all along the guide rail 10 and gear way 15, though there are both straight and curving guide rail and gear way segments connected with each other.

The like numbers indicate the like members hereafter.

The carrier 20 is of bogie type. It comprises a first frame 22, a second frame 23, a top plate 21 bridging the frames 22 and 23, and a geared motor 24 mounted on the top plate 21.

The first frame 22 is provided with a driving roller assembly 45 and a non-driving roller assembly 46 at both guide sides 12 of the guide rail 10. The second frame 23 is provided with a pair of non-driving roller assemblies 46 at both guide sides 12.

Figure 10:
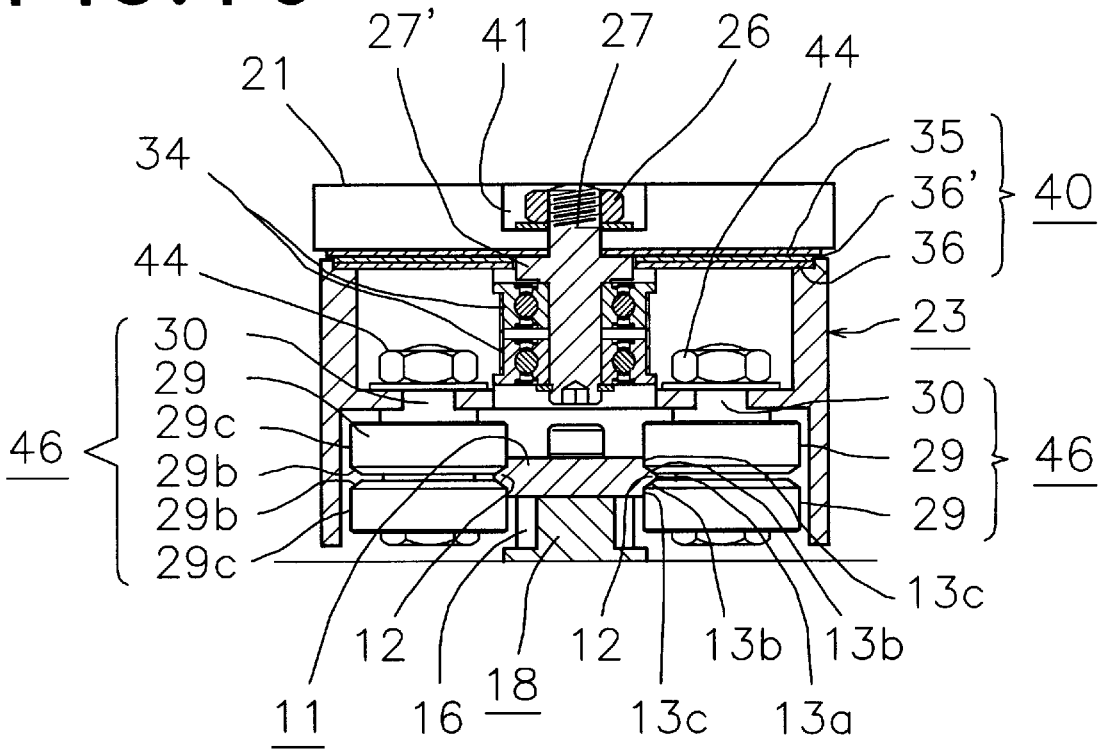
FIG. 10 is a vertical section taken approximately on the line X—X in FIG. 9, where the rollers are not sectioned.

In the second frame 23, the non-driving roller assemblies 46 are secured to the frame 23 with nuts 44 and their cooperative washers for supporting the carrier 20 by engaging with the opposed parallel guide sides 12 respectively as shown in FIG. 10.

Each of the non-driving roller assemblies 46 comprises a journal 30 and a pair of ball bearings 29 mounted on the journal 30 with a space left between the pair of ball bearings 29. Each ball bearing 29 includes an outer race 29*c* which engages with each of the parallel plain lanes 13*c* and which has a beveled corner 29*b* facing to the V edge 13. Each ball bearing 29 is adapted to cooperate with the V edge 13 such that the beveled corner 29*b* engages with the V edge base portion 13*b*, and such that the V edge top portion 13*a* remains in the space between the pair of ball bearings 29 without engaging the outer race 29*c*.

As shown in FIG. 10, the second frame 23 is in a freely rotatable relation to a central shaft 27 by means of bearings 34 fixed to the second frame 23. The central shaft 27 is secured to the top plate 21 with a nut 26 and its cooperative washer within a recess 41 provided on the top plate 21. Thus the second frame 23 is in a freely rotatable relation to the top plate 21.

In addition, the top plate 21 is supported on the frame 23 by the intermediary of a plane bearing 40, which comprises an upper metallic member 35, a lower metallic member 36 and a middle resinous element 36'. The upper member 35 is fixed to the top plate 21 by means of the nut 26 and a shoulder 27' of the central shaft 27. The lower member 36 is fixedly supported on the second frame 23. The middle resinous element 36' is made of fluorine resin and fixed to the lower member 36 with adhesive. The resinous element 36' is in a freely slidable relation to the upper member 35. The plane bearing 40 helps the second frame 23 to rotate freely in relation to the top plate 21.

In the first frame 22, the non-driving roller assembly 46 has the same construction and functions as those roller assemblies in the second frame 23. The driving roller assembly 45 comprises a journal 31, a ball bearing 29 and a pinion 32, the latter two being mounted on the journal 31 with a space left between them.

The ball bearing 29 has the construction and functions similar to those ball bearings in the non-driving assembly 46. The driving roller assembly 45 is connected with the first frame 22 by means of bearings 33 for supporting the carrier 20 by engaging with one of the guide sides 12 as best shown in FIG. 2.

Figure 9:
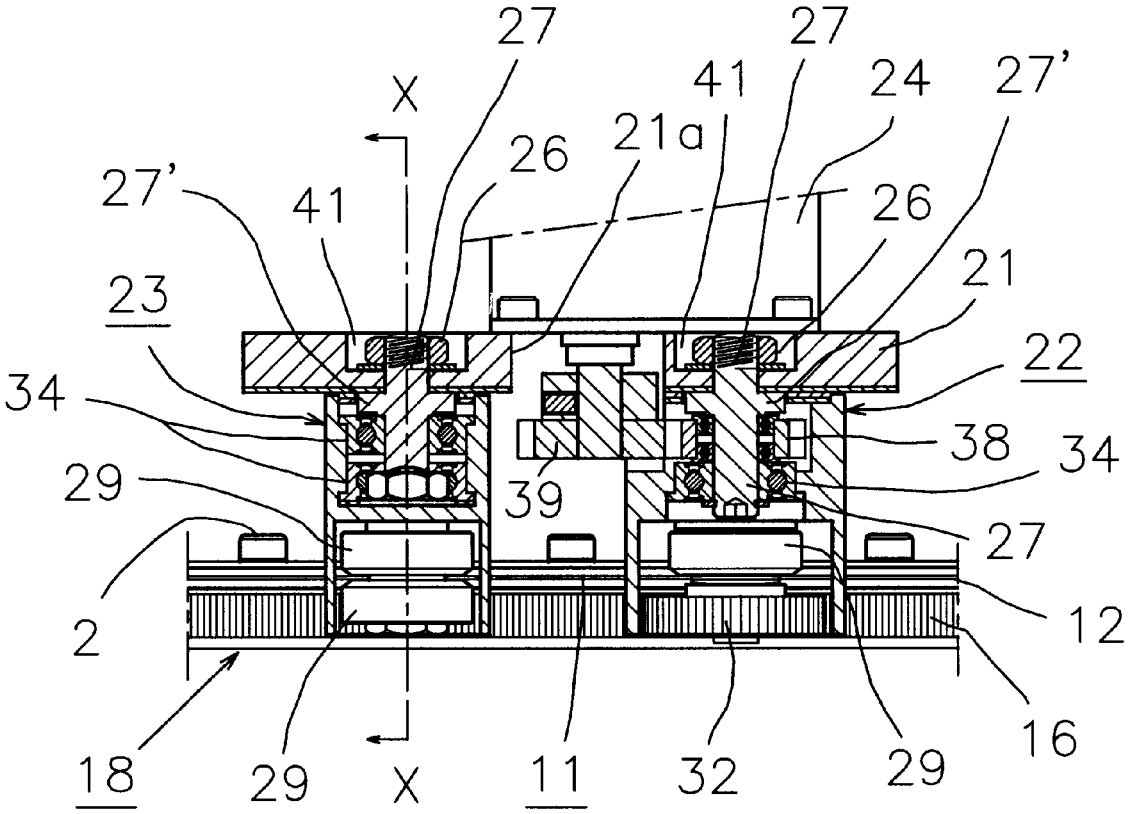
FIG. 9 is vertical section in part taken approximately on the line IX—IX in FIG. 1, where the pinion, rollers, guide rail and gear way are not sectioned.

The pinion 32 is mounted on one end of the journal 31, while a gear 37 is mounted on the other end of it. The geared motor 24 has a drive shaft with a gear 39, for which the top plate 21 is provided with an opening 21*a* through it as best shown in FIG. 9. The gear 37 is connected with the gear 39 by the intermediary of an idle gear 38. The pinion 32 engages with one of the gear sides 16. Thus the driving roller assembly 45 is connected to the geared motor 24 for driving the carrier 20 by engaging with one of the gear sides 16.

Figure 1:
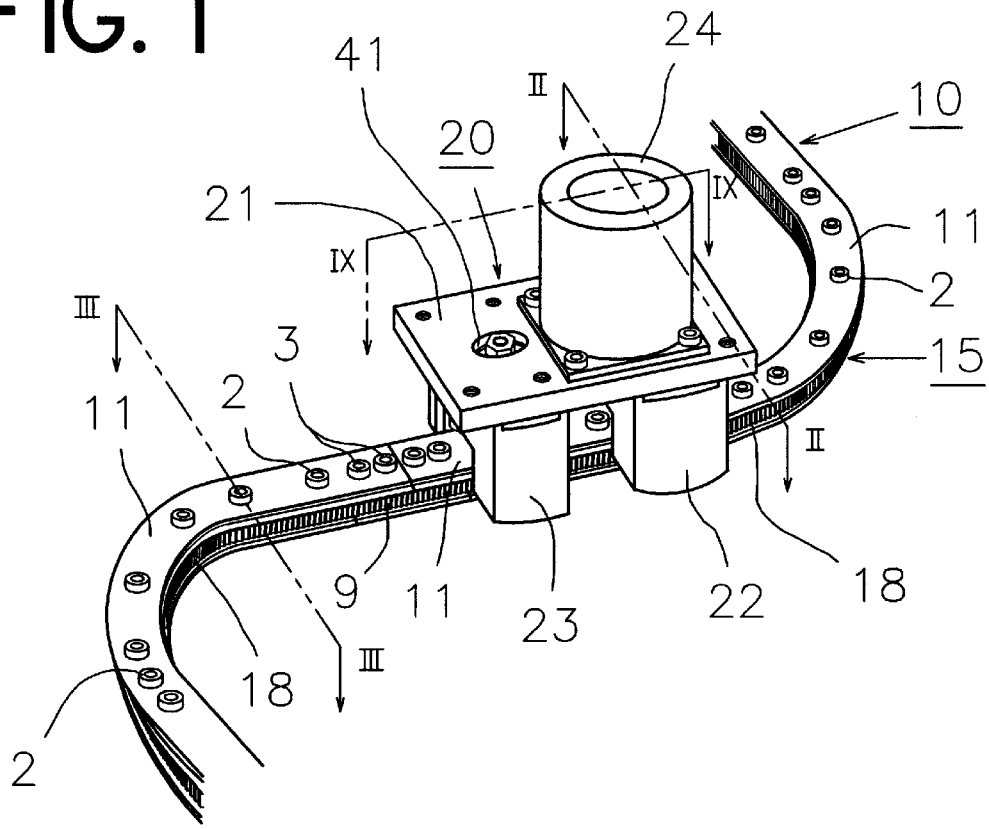
FIG. 1 is a perspective view of a streamline track system in part embodying the invention.
Figure 2:
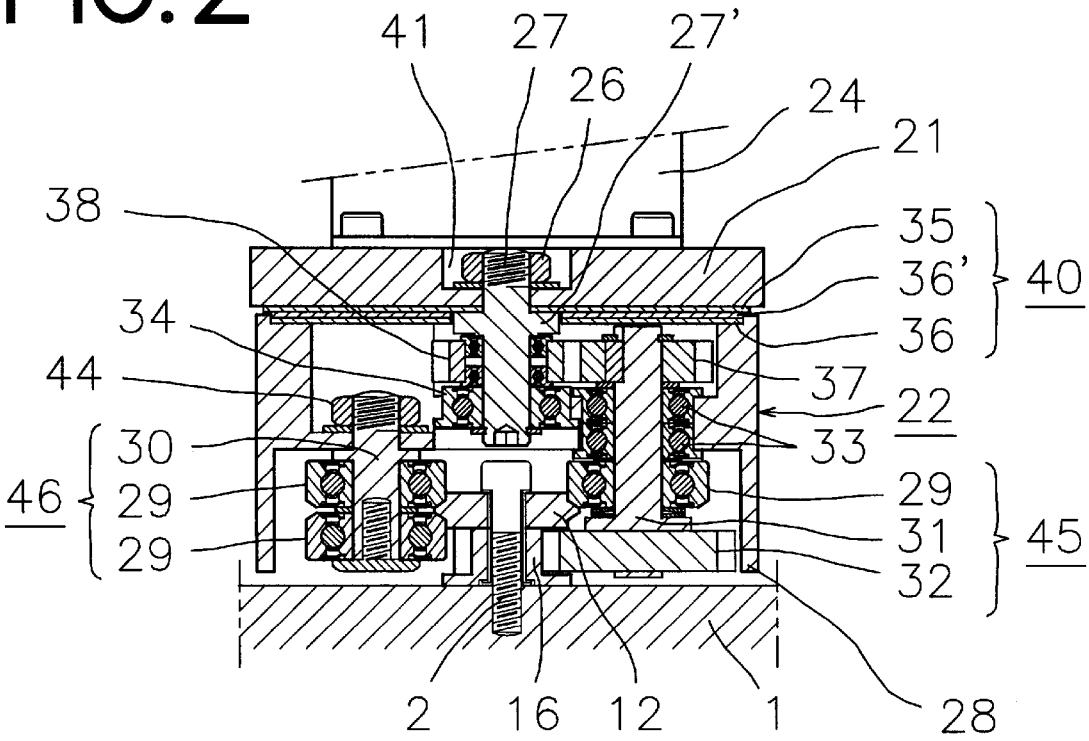
FIG. 2 is a vertical section in part taken approximately on the line II—II in FIG. 1, where the track system is fixed to a supporting structure on one plane.

As shown in FIG. 2, the first frame 22 is in a freely rotatable relation to the top plate 21 similarly to the second frame 23. In addition, the top plate 21 is also supported on the first frame 22 by the intermediary of a plane bearing 40, which helps the first frame 22 to rotate freely in relation to the top plate 21 just similarly to the second frame 23.

The carrier 20 runs automatically along the guide rail 10 as the geared motor 24 drives the pinion 32 in engagement with the gear way 15, while all the rollers 29 are in engagement with the guide rail 10.

Figure 11:
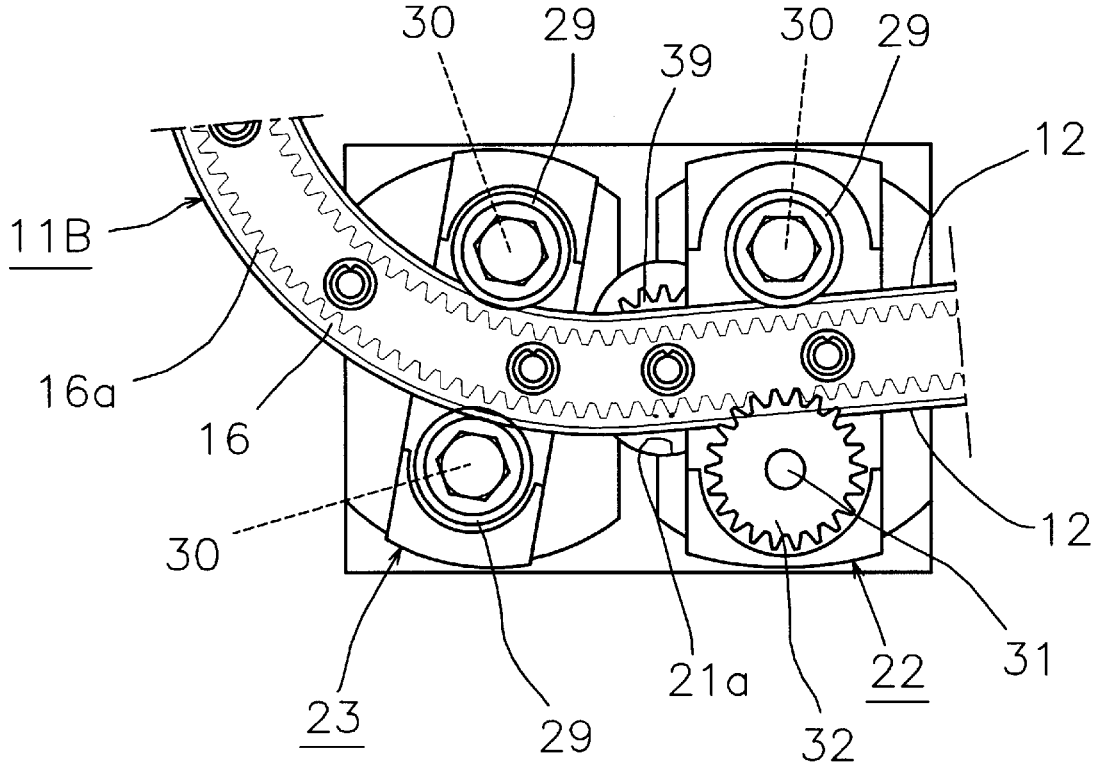
FIG. 11 is an enlarged view showing the cooperating relation of the guide rail, gear way, carrier rollers and pinion in FIG. 1 through 10, when the carrier runs along a curving guide rail segment.

As the carrier 20 runs along one of the curving guide rail segments 11 combined with one of the curving gear way segments 18, the first and the second frame 22 and 23 rotate freely in relation to the top plate 21, so that it may pass the curving guide rail and gear way segment without any difficulty as shown in FIG. 11. Both frames 22 and 23 are provided with skirts 28 for protection and safety purpose.

Since the gear way segments 18 are molded with reinforced thermosetting resin, not only straight but also various curving gear way segments can be manufactured quite accurately with ease and low cost. It is noted that each of the curving gear way segments 18 has straight extensions formed integrally at both ends of a curving middle part. Even such a configuration can be manufactured with reinforced thermosetting resin accurately with ease and low lost.

Since the gear way segments 18 are provided with a pair of opposed parallel gear sides 16 with gear teeth 16*a* of a given pitch, natural deformation after molding of the gear way segments can be minimized, and this will add much to accuracy.

Moreover, each of these gear way segments 18 permits either of its gear sides 16 to be used for running, and this will require less molds and simplify the molding process. For instance, the pair of curving gear way segments in the S shape in FIG. 8 can be manufactured with one mold.

The ribs 17 protruded outwardly from one of the set sides 16' will help minimize natural deformation after molding of the gear way segments 18 quite effectively, facilitate handling the gear way segments with tools for grinding and other purposes after molding, and serve as a firm stand for stable installation on a supporting structure on one plane.

The symmetrical arrangement of gear teeth 16*a* along the straight extensions of each curving gear way segment 18 makes it possible to form the straight extensions integrally at both ends of the curving middle part without disturbing the pitch of gear teeth 16*a*, whatever curvature it may have.

Since the gear teeth 16*a* are arranged symmetrically along each straight gear way segment, both straight extensions of each curving gear way segment and each straight joint member 9, the straight and curving gear way segments can be connected with each other by the intermediary of joint members 9 into a gear way 15 of any desired length without disturbing the pitch of gear teeth 16*a*, whatever curvature and length it may have.

Moreover, the existence of straight extensions with gear sides 16 in each curving gear way segment 18 will be quite effective to keep the curving middle part from deforming naturally after molding, that is, from opening both ends of it outwardly to an undue extent. This will also add to accuracy.

Molding thermosetting resin further makes it possible to manufacture gear way segments of any desired width and height as well as length accurately with ease and low cost. For instance, the configuration of gear way segment shown in FIG. 3 is considerably compact, as it is even narrower than the guide rail segment 11 combined with it, and as it is only as high as to allow the pinion 32 to run easily as shown in FIG. 2, given the length of the guide rail segment.

Since the thermosetting resin is reinforced with carbon fiber, glass fiber and/or laminates of a woven fabric impregnated with thermosetting resin, the gear way segments 18 have good mechanical strength and durability, though they are naturally light. Even the gear teeth 16*a* are not liable to break for a long period of service, because they are sufficiently reinforced.

Since each guide rail segment 11 is combined with a gear way segment 18 in a closely fitting relation to each other while each hollow rivet 19 fits closely to the insides of rivet holes 11*a* and 18*a* with its resiliency, the guide rail segment and its own combined gear way segment will not get loosened for a long period of service. This will increase the structural strength and durability of the guide rail 10 and gear way 15 considerably.

Because the expanded end of each resilient hollow rivet 19 on the surface of guide rail segment 11 serves as a washer for the set bolt 2, there is no need of such washers, and this will save cost and labor in installation so much.

The radial expansibility of hollow rivets 10 will permit the diameter of rivet holes 11*a* and 18*a* to be made slightly larger than the diameter of hollow rivets 19 before use. Thus the hollow rivets can be put into the rivet holes 11*a* and 18*a* with ease on use.

The plane bearings 40 are so thin as to make the carrier so much light and compact. The resinous element 36' absorbs the running vibration as to permit the frames 22 and 23 to rotate in relation to the top plate 21 with so much ease and noiselessness.

The gear way 15 with a pair of opposed parallel gear sides having symmetrically arranged gear teeth 16*a* of a given pitch will facilitate to determine precisely the positions where the carrier is to start and stop running along the guide rail 10.

In addition, the gear way 15 will make it possible to provide acute curving anywhere along the guide rail 10, and this will permit installation in limited and/or complicated spaces.

Moreover, the resinous gear way 15 will permit of quite light and noiseless running for a long period of service with minimized maintenance.

And all the above-described features and advantages are to be newly added to those already disclosed in my U.S. Pat. No. 5,735,214.

The embodiment in FIGS. 12 through 15 is fundamentally similar to the one in FIGS. 1 through 11, but it has a guide rail 50 and a gear way 55 with a substantially spherical running direction.

Figure 13:
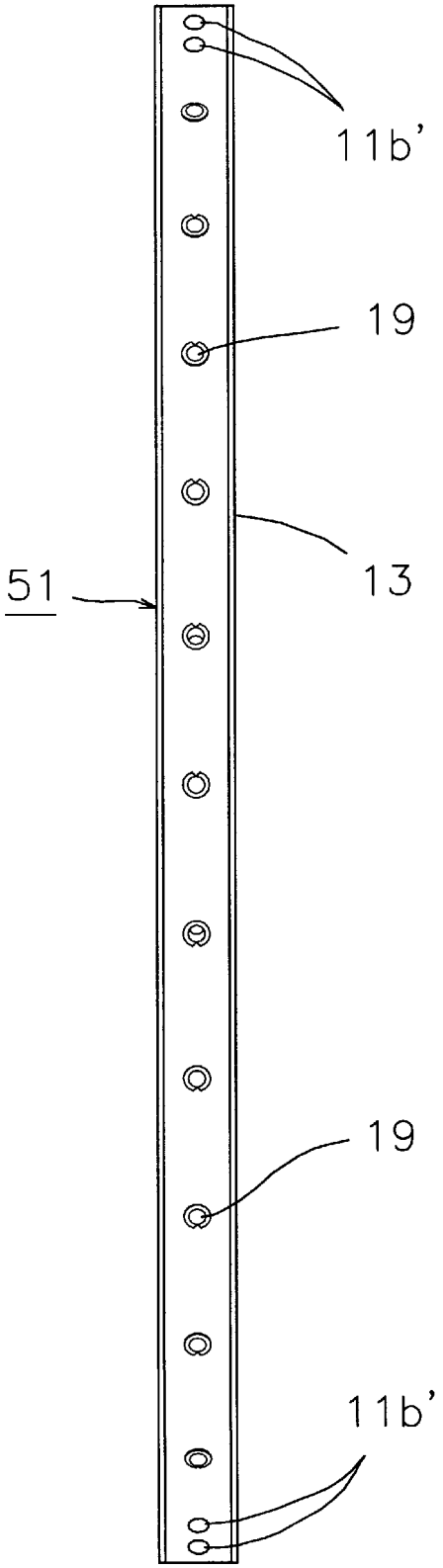
FIG. 13 is a front view of a guide rail segment combined with a gear way segment in FIG. 12.
Figure 14:
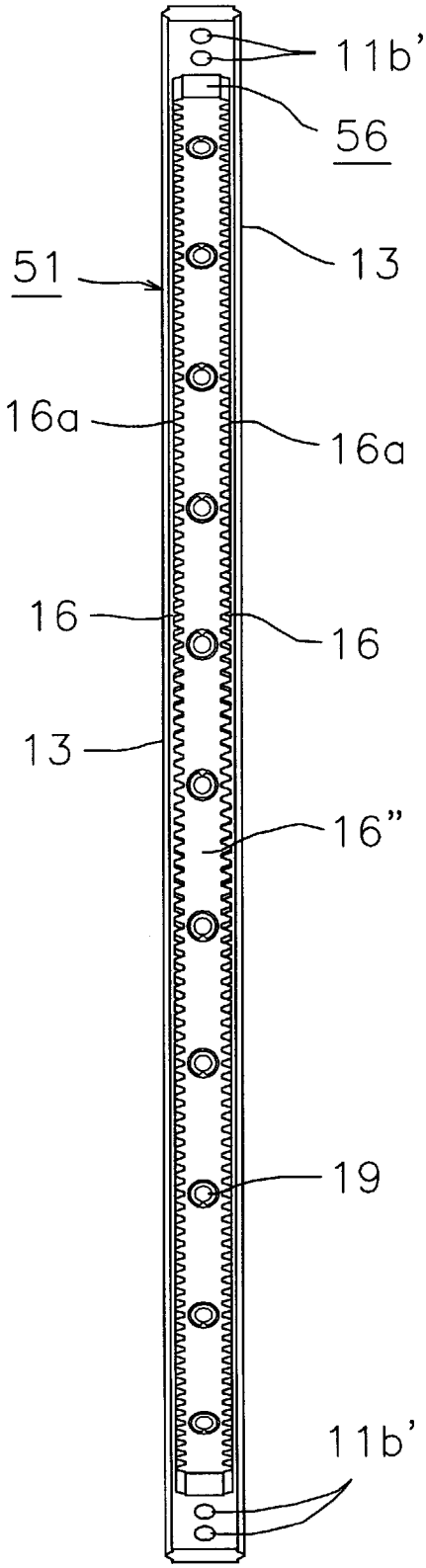
FIG. 14 is a rear view of the embodiment in FIG. 13.
Figure 15:
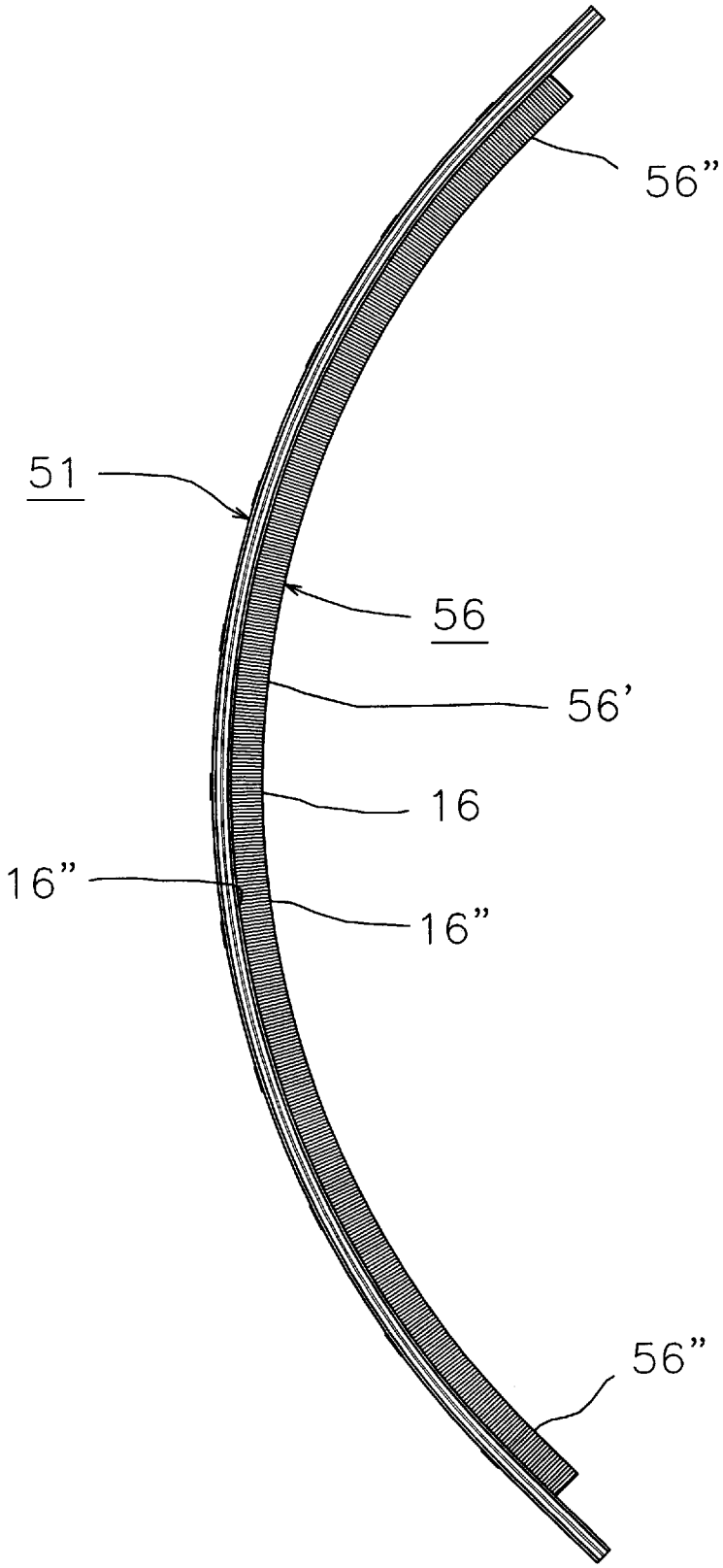
FIG. 15 is a right side view of the embodiment in FIG. 13.

The guide rail 50 may include such a guide rail segment combined with a gear way segment as shown in FIGS. 13 through 15, where they are designated as 51 and 56 respectively.

The gear way segment 56 is provided with a pair of opposed parallel gear sides 16 having gear teeth 16*a* and a pair of opposed parallel set sides 16" similarly to the embodiment in FIGS. 1 through 11, except that neither of the set sides 16" is provided with ribs protruded outwardly.

The gear way segment 56 is made initially as a straight gear way segment by molding just similarly to the embodiment in FIGS. 1 through 11, then putting it in a bending pattern while it is still hot, and then cooling it as it is in the pattern, such that the gear way segment 56 has a curving middle part 56' and straight extensions 56" formed integrally at both ends of it as best shown in FIG. 15. In this case, the set sides 16" of the middle part 56' are bent sectorially to a practically allowable extent, while the gear sides 16 of the whole gear way segment 56 and the set sides 16" of the straight extensions 56" are not bent at all.

Because the gear way segment 56 is made initially as a straight gear way segment, the gear teeth 16*a* are initially arranged symmetrically on both gear sides 16 with a given pitch. The set sides 16" of the middle part 56' can be bent sectorially without disturbing the pitch of gear teeth 16*a* significantly, as the pitch of gear teeth 16*a* on the pitch circle in the middle of both set sides 16" remains significantly unchanged without either widening or shortening. And the set sides 16" of middle part 56' can be bent sectorially without difficulty, because neither of them is provided with ribs protruded outwardly.

The guide rail segment 51 is combined with the gear way segment 56 with hollow rivets 19, and they are connected with adjacent guide rail segments and gear way segments by the intermediary of joint members 9', similarly to the embodiment in FIGS. 1 through 11, except that the guide rail segment 51 combined with the gear way segment 56 is fixed to supporting structures 4 with set bolts 3' which pass through the guide rail segment 51 and the joint members 9' in both ends of it; for this purpose, the guide rail segment 51 is provided with bolt holes 11*b*' in both ends of it.

Figure 12:
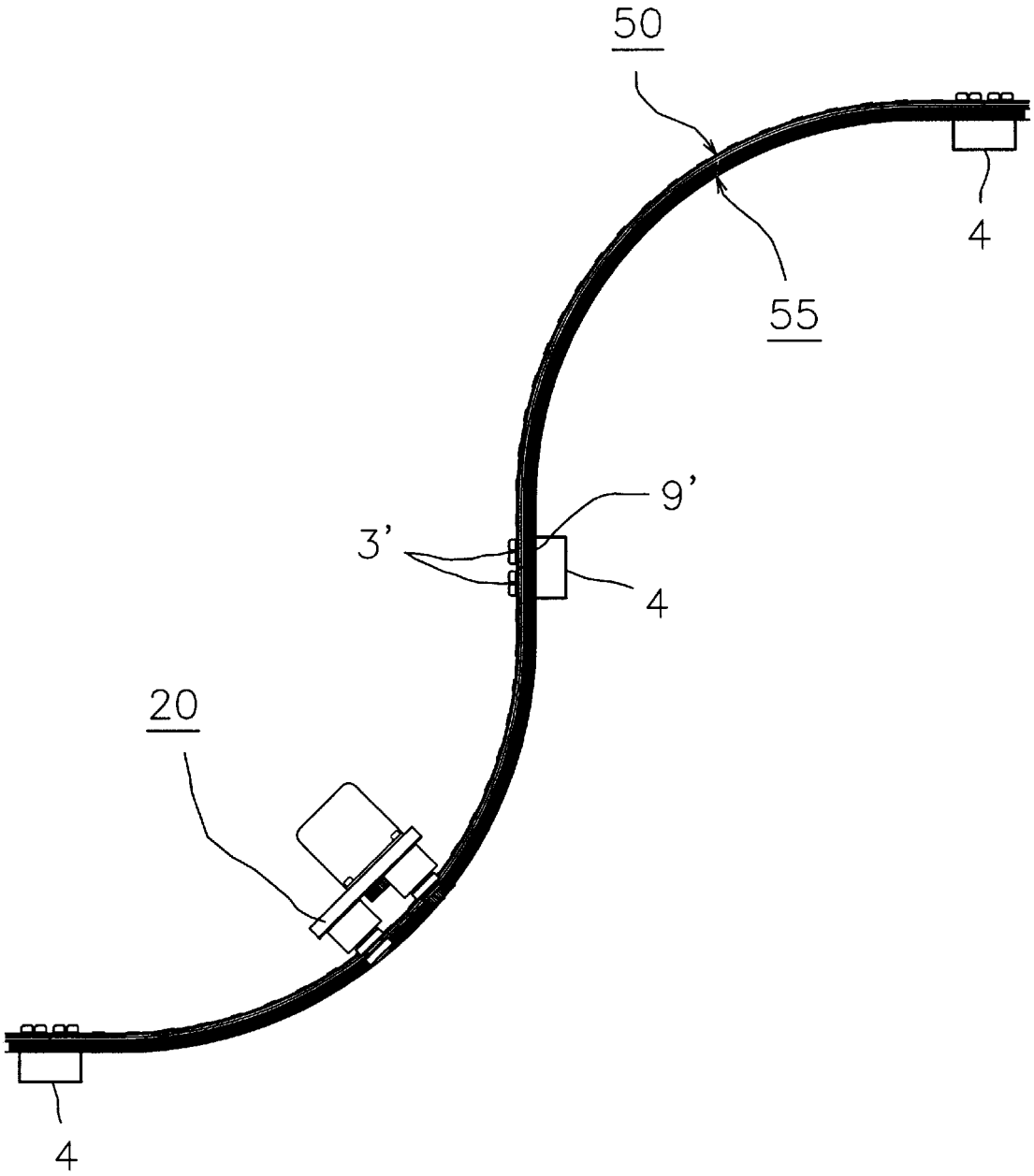
FIG. 12 is a right side elevation of another embodiment in part.

The guide rail 50 and gear way 56 are fixed to a plurality of supporting structures 4 which are arranged in such three-dimensions as to provide a substantially spherical running direction as shown in FIG. 12.

Figure 16:
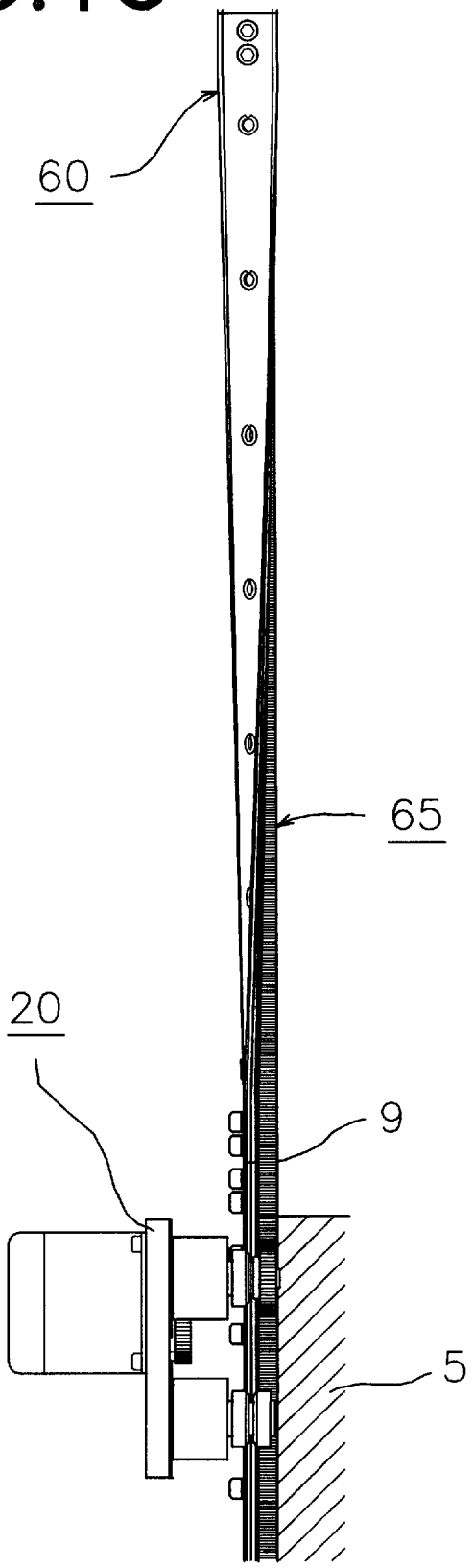
FIG. 16 is a right side elevation of still another embodiment in part.
Figure 17:
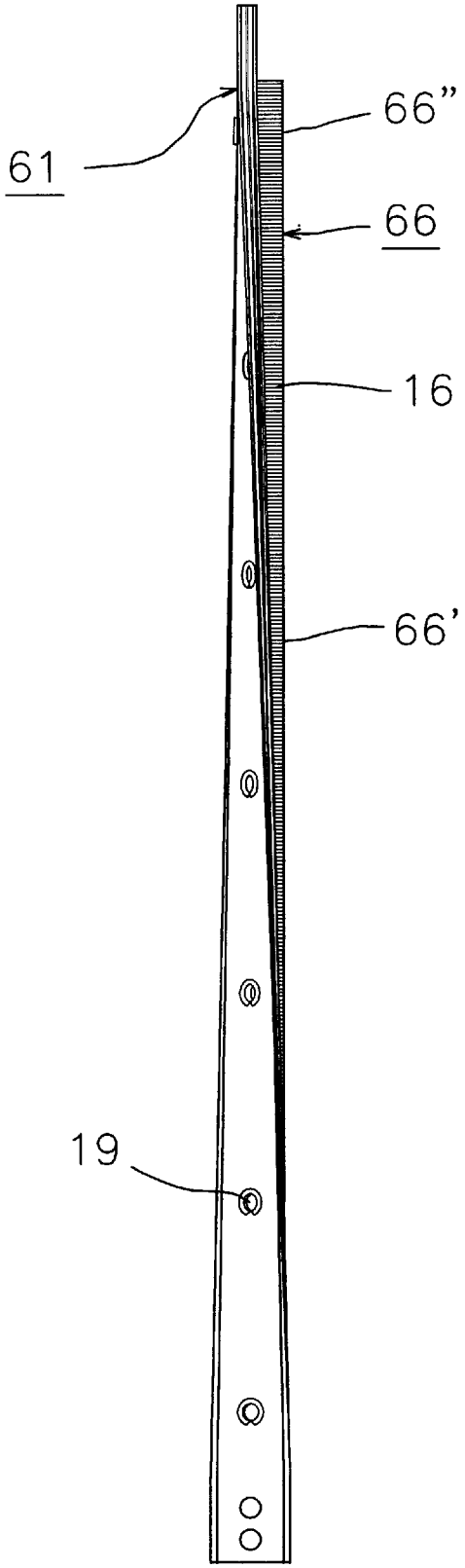
FIG. 17 is a rear view of a guide rail segment combined with a gear way segment in FIG. 16.

The embodiment in FIGS. 16 and 17 is fundamentally similar to the one in FIGS. 12 through 15, but it has a guide rail 60 and a gear way 65 with a substantially spiral running direction.

The guide rail 60 may include such a guide rail segment combined with a gear way segment as shown in FIG. 17, where they are designated as 61 and 66 respectively.

The gear way segment 66 is provided with a pair of substantially opposed parallel gear sides 16 having gear teeth and a pair of substantially opposed parallel set sides 16" similarly to the embodiment in FIGS. 12 through 15; neither of the set sides 16" is provided with ribs protruded outwardly.

The gear way segment 66 is made initially as a straight gear way segment by molding just similarly to the embodiment in FIGS. 1 through 11, then putting it in a twisting pattern while it is still hot, and cooling it as it is in the pattern, such that the gear way segment 66 has a curving middle part 66' and straight extensions 66" formed integrally at both ends of it as best shown in FIG. 17. In this case, the middle part 66' is twisted spirally to a practically allowable extent.

Because the gear way segment 66 is made initially as a straight gear way segment, the gear teeth are initially arranged symmetrically on both gear sides 16 with a given pitch. The middle part 66' can be twisted spirally without disturbing the pitch of gear teeth substantially. And the middle part 66' can be twisted spirally without difficulty, because neither of the set sides 16" is provided with ribs protruded outwardly.

The guide rail segment 61 is combined with the gear way segment 66 with hollow rivets 19, and they are connected with adjacent guide rail segments and gear way segments by the intermediary of joint members 9, similarly to the embodiment in FIGS. 1 through 11. The guide rail 60 and gear way 65 are fixed partially to a vertical supporting structure 5 as shown in FIG. 16.

The embodiments in FIGS. 12 through 17 have three-dimensional running directions. Various other three-dimensional running directions can be provided similarly.

The three-dimensional running directions will permit wider choice of installation space. This will be especially effective for installation in limited and/or complicated spaces, for instance, in old buildings.

It will be understood that further modifications may be made in constructions of the above-given embodiments, and that the invention is in no way limited to the above-given embodiments.

What I claim is:

1. A track system comprising:

a guide rail having a plurality of straight and curving guide rail segments to be connected with each other, each of said guide rail segments having a pair of opposed parallel guide sides and a pair of opposed parallel set sides, each of said guide sides being provided with a pair of parallel plain lanes and a V edge protruded between said parallel plain lanes, said set sides being provided with rivet holes therethrough;

a gear way combined with said guide rail and having a plurality of straight and curving gear way segments to be connected with each other by the intermedilary of straight joint members, each of said gear way segments and said straight joint members having a pair of opposed parallel gear sides and a pair of opposed parallel set sides, both of said gear sides being provided with gear teeth of a given pitch, said set sides being provided with rivet holes therethrough; and at least one carrier adapted to run along said guide rail automatically and including a geared motor and two pairs of roller assemblies, one of said roller assemblies being provided with a roller and a pinion, the others of said roller assemblies being provided with a pair of rollers respectively, said rollers being adapted to engage with said guide sides to support said carrier, said pinion being adapted to engage with one of said gear sides to drive said carrier in a driving relation to said geared motor.

2. A track system as claimed in claim 1, wherein each of said curving guide rail segments has a curving middle part and straight extensions formed integrally at both ends of said curving middle part, each of said curving gear way segments has a curving middle part and straight extensions formed integrally at both ends of said curving middle part, and said gear teeth of a given pitch are arranged symmetrically on both of said gear sides along said straight gear way segments, said straight extensions of said curving gear way segments and said straight joint members.

3. A track system as claimed in claim 2, wherein each of said gear way segments and said joint members is molded with thermosetting resin reinforced with fiber and laminates of a woven fabric impregnated with thermosetting resin.

4. A track system as claimed in claim 3, wherein said thermosetting resin is phenol resin.

5. A track system as claimed in claim 3, wherein said fiber is carbon fiber.

6. A track system as claimed in claim 3, wherein said fiber is glass fiber.

7. A track system as claimed in claim 3, wherein each of said guide rail segments is combined with one of said gear way segments by putting resilient hollow rivets through said rivet holes.

8. A track system as claimed in claim 7, wherein said resilient hollow rivets are made of spring stainless steel.

9. A track system as claimed in claim 7, wherein one of said set sides in each of said gear way segments and said straight joint members is provided with ribs protruded outwardly.

10. A track system as claimed in claim 7, wherein said set sides of said curving middle part in each of said curving gear way segments are curved sectorially while the gear sides thereof are not curved.

11. A track system as claimed in claim 7, wherein said curving middle part in each of said curving gear way segments is curved spirally.

* * * * *